United States Patent [19]

Groetsch

[11] Patent Number: 4,952,088

[45] Date of Patent: Aug. 28, 1990

[54] CLIP OF CAPS ADAPTED TO REMOVE SHAFT

[75] Inventor: Gerald Groetsch, Fürth, Fed. Rep. of Germany

[73] Assignee: J.S. Staedtler GmbH & Co., Nuremberg, Fed. Rep. of Germany

[21] Appl. No.: 280,385

[22] Filed: Dec. 6, 1988

[30] Foreign Application Priority Data

Dec. 10, 1987 [DE] Fed. Rep. of Germany ..... 3741885

[51] Int. Cl.[5] ..... B43K 9/00; B43K 13/00

[52] U.S. Cl. ..... 401/195; 401/243; 401/258

[58] Field of Search ..... 401/258, 195, 243

[56] References Cited

U.S. PATENT DOCUMENTS 3,830,574 8/1974 Glombitza et al. ..... 401/258 X 4,558,966 12/1985 Mikuteit ..... 401/258 X

FOREIGN PATENT DOCUMENTS 530283 7/1955 Italy ..... 401/258

*Primary Examiner*—Steven A. Bratlie

*Attorney, Agent, or Firm*—Pascal & Associates

[57] ABSTRACT

To screw the writing tip in and out of the instrument shaft of a writing or drawing instrument, the cap has been used as a screwing tool. The cap is usually fabricated with a many-sided receiving bore for this purpose as an extension of its bore, which can be placed onto the writing tip after the cap has been turned around. As a result, the cap is relatively long. The writing or drawing instrument of the present invention in contrast, has a cap of standard length. A many-sided receiving bore which is to be placed on the writing tip, in order to be able to screw it in or out, is formed, in part, by the clip of the cap, and in part by the wall of cap in the region where the clip is connected to the cap.

13 Claims, 3 Drawing Sheets

FIG. 10c
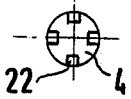
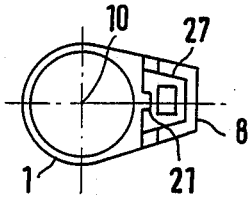
FIG. 10b
FIG. 10a
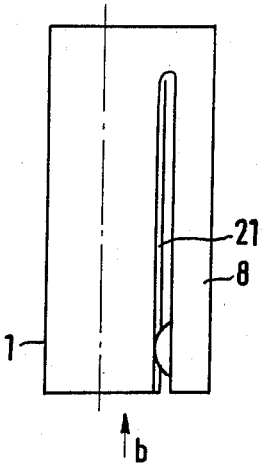
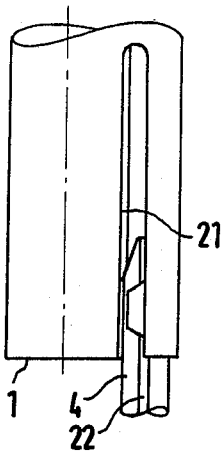
FIG. 10d
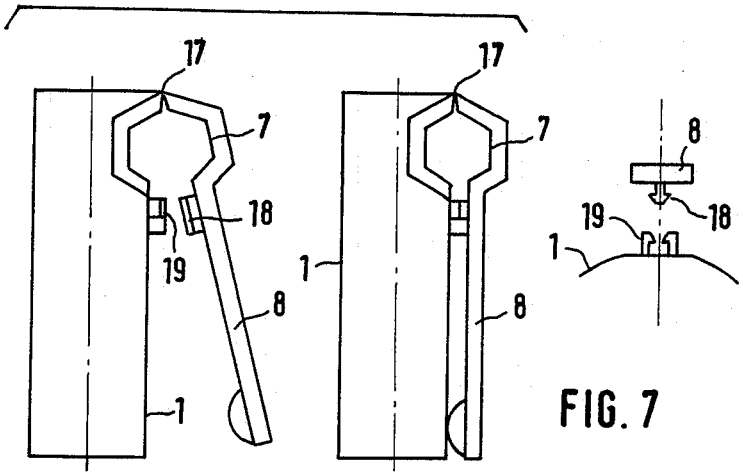
FIG. 7

CLIP OF CAPS ADAPTED TO REMOVE SHAFT

This invention concerns a writing or drawing instrument having a writing insert that can be removed from the instrument and a cap having a receiving bore that can be put on over the writing insert.

The German Industrial Design No. DE-GM 81 36 741, a tool is mounted on the end of the writing instrument shaft; the tool has a hexagonal receiving bore and, in extension of this receiving bore, a slotted tubular attachment. This tool can be placed onto the writing insert having a hexagon (cross-section front), whereby the walls of the tubular attachment come to rest against the conical tip of the writing insert, which is thus held by the tool. The length of the instrument shaft is thus determined by the length of the tool.

The instrument shaft according to German Offenlegungsschrift No. DD-OS 22 22 593 has hexagonal receiving bores extending diagonally to its axis, with which the writing insert can be screwed out of the head of the writing instrument when the instrument shaft with a receiving bore, which has been removed from the head, is placed onto the writing insert. It is a disadvantage that the unscrewed writing insert is not fixed by the instrument shaft.

It is an object of the present invention to improve the writing or drawing instrument in such a way that the axial length of the cap is not dependent on the length of the receiving bore.

This is achieved in accordance with the present invention, in which an embodiment is a writing instrument having a writing insert which can be screwed in or out of the instrument shaft and a cap which can be placed over the writing insert and which has a clip and a receiving bore which can be placed onto the writing insert, the writing insert being removable from or inserted into the instrument shaft by means of the cap having the mounting insert disposed within the receiving bore, the receiving bore being many sided and being formed in part by the clip and in part by the outer wall of the cap.

The part of the clip forming one part of the receiving bore being shiftable with respect to the outer wall of the cap forming the other part of the receiving bore. The torque which acts on the instrument tip when the writing insert is screwed into the instrument shaft is thus limited by expanding the receiving bore.

Embodiments of the invention are described in greater detail below, with reference to the drawings, in which:

FIG. 7 are views of a cap according to a fourth embodiment with a schematic representation of the connection between cap and clip;

Figure 1:
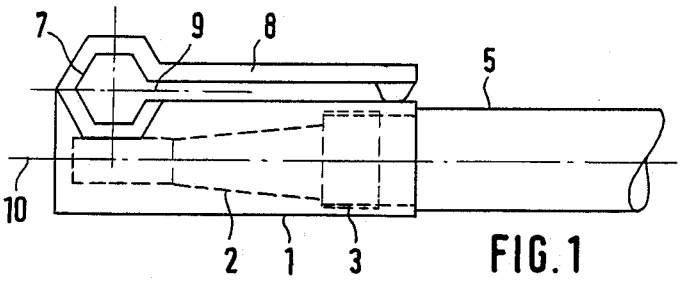
FIG. 1 is a side view of the upper part of a writing instrument according to a first embodiment having a cap mounted or screwed onto the instrument shaft to protect the writing insert.

FIGS. 10A, B, C, D are side views and a top view of a cap as well as the section through a writing insert according to a seventh embodiment.

A cap 1 according to FIGS. 1 to 4 is closed at one end and has the usual bore 2, which is provided with an internal thread 3. With this bore 2, the cap 1 can be put on over the writing insert 4 and can, with its inner thread 3, be screwed together with an external thread on the instrument shaft 5. This corresponds to the standard construction of a writing or drawing instrument in which cap 1 is thus determined by the necessary length of the bore 2 which, for its part, is determined by the length of the part of the writing insert 4 which projects beyond the instrument shaft 5 and by the length of the thread. This cap, therefore, has the standard cap length.

In the embodiment illustrated, a part of the writing insert 4 is formed as a hexagon 6 (cross-section). At the upper part of cap 1, where bore 2 has significantly reduced cross-section, half of a hexagonal receiving bore 7 is formed by the cap well. The other half of the hexagonal receiving bore is formed by a clip 8 which is connected to the cap wall at the upper end. In this way, a hexagonal receiving bore 7 results which has a radially extending slot 9 formed by the distance between clip 8 and the wall of cap 1. The free end of clip 8 extends, in a known manner, parallel to the axis 10 of cap 1.

Figure 2:
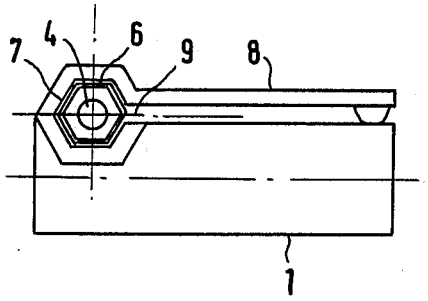
FIG. 2 is a view of the cap corresponding to FIG. 1, which is placed onto the writing insert with its receiving bore.
Figure 3:
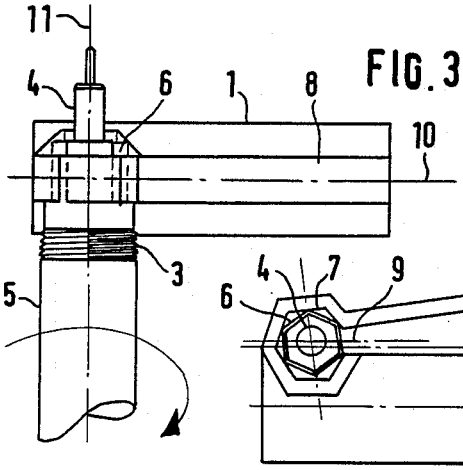
FIG. 3 is a sectional side view of the cap having the receiving bore placed onto the writing insert.

To screw the writing insert 4 in and/or out of the instrument shaft 5, cap 1, with its receiving bore 7, is placed onto hexagon 6 of writing insert 4, as shown in FIGS. 2 and 3. The writing insert 4 can be screwed in and/or out by a relative rotation between cap 1 and shaft 5.

Figure 4:
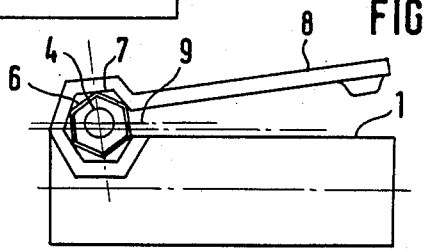
FIG. 4 is a view corresponding to FIG. 2 to illustrate how torque limitation is achieved.

Due to slot 9 and due to the flexibility of clip 8, only limited torque can be transferred to the writing insert 4. If this torque is exceeded, then the receiving bore 7 expands, as shown in FIG. 4, so that the writing insert 4 is turned relative to cap 1. Damage to the thread of writing insert 4 and shaft 5 is thus avoided.

Other polygons or serrations can be used in place of hexagon 6 and the hexagonal receiving bore 7, which is also true for the following embodiments.

Figure 5:
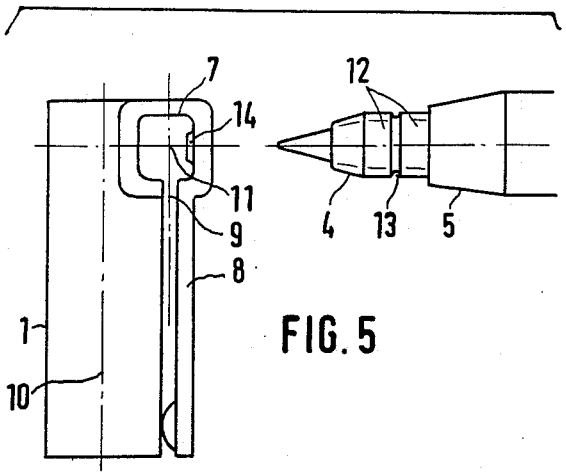
FIG. 5 is a side view of a cap and a writing insert inserted into the instrument shaft, according to a second embodiment.

In an embodiment shown in FIG. 5, axis 11 of receiving bore 7 extends at right angles to the axis 10 of cap 1, as described in the preceding embodiment. The embodiment in FIG. 5 concerns a square receiving bore 7. The writing insert 4 is also provided with a square (cross-section), which has a circular recess 13. The receiving bore has a protrusion 14 pointing toward the axis 11. This protrusion 14 is formed onto the part of the receiving bore 7 formed by clip 8. If cap 1 with the receiving bore 7 is mounted onto the writing insert 4, then receiving bore 7 is expanded until the protrusion 14 engages in recess 13. As a result of protrusion 14 engaging in recess 13, the writing insert 4 is held by cap 1, so that it is not detachable. If cap 1 is removed from the writing insert 4, receiving bore 7 again expands until protrusion 14 frees itself from the square 12. In all other aspects, the same holds true for this embodiment as was stated for the embodiment according to FIGS. 1 to 4.

Figure 6:
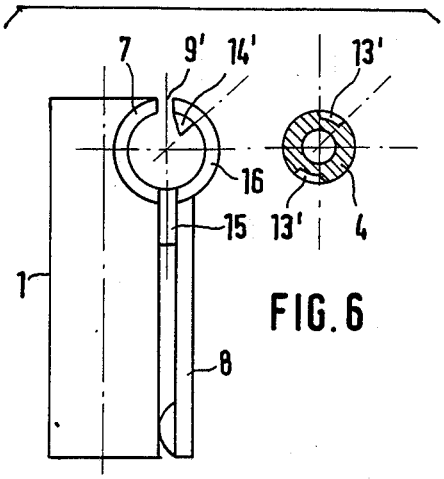
FIG. 6 is a side view of a cap and a section through a writing insert according to a third embodiment.

In the embodiment shown in FIG. 6, the receiving bore 7 is shaped as a circle. A flange 15 extends to the wall of cap 1 between the free end of clip 8 and the receiving bore 7. Slot 9' is provided at the upper end. In this way, half of the receiving bore is formed by the flexible arm 16 on whose end a tooth-shaped protrusion 14' is formed. This tooth-shaped protrusion 14' has a radially and a diagonally extending flange.

The writing insert 4 is provided with segmental recesses 13'. These segmental recesses 13' are limited, on the one hand, by a radially extending flange and, on the other hand, by a diagonally extending flange.

If cap 1 with its receiving bore 7 is mounted on writing insert 4, in such a way that the tooth-shaped protrusion 14' engages in one of the recesses 13', then a high torque is transmitted onto the writing insert 4 in the direction of rotation in which the radial flanges are adjacent to one another. In contrast, in the other direction of rotation, when the diagonal flanges are adjacent to one another, the torque to be transmitted is slight. Thus when the writing insert 4 is being screwed in, a high torque is attained which acts on the writing insert. When a certain torque is attained, the tooth-shaped protrusion 14' deviates radially outward due to the flexibility of arm 16. In contrast to this, the transmitted torque is slight in the other direction of rotation, so that the writing insert 4 is ensured against being tunnel back, except if a pressure is exerted by a finger on arm 16.

In the embodiment shown in FIG. 7, clip 8 is connected to the wall of clip 8 at its upper end via a film hinge 17. As in the first embodiment, one half of receiving bore 7 is formed by the wall of cap 1 and the other half by the upper part of clip 8. A spring lock connection is provided between receiving bore 7 and the free end of clip 8, the spring lock connection being comprised on the one hand, of a barbed flange bar 18 on the clip 8, and on the other hand, of two barbs 19 on cap 1. When clip 8 is placed against cap 1, flange bar 18 snaps behind barbs 19. This spring lock connection, however, disengages when the torque transmitted via receiving bore 7 reaches a certain value. A torque limitation is also attained in this way.

Figure 8:
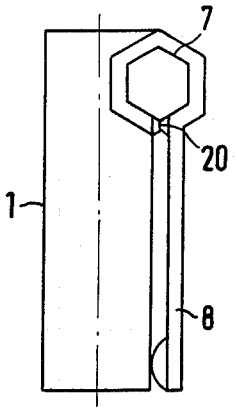
FIG. 8 is a side view of a cap according to a fifth embodiment.

The embodiment shown in FIG. 8 corresponds to the one in FIGS. 1 to 4, with the exception, however, that a preset breaking point 20 is provided between clip 8 and the wall of cap 1 in place of slot 9. This preset breaking point 20 is destroyed when too great a torque is transmitted to the writing insert 4 via receiving bore 7. Thus, the same circumstances exist as described with reference to FIG. 4.

Figure 9:
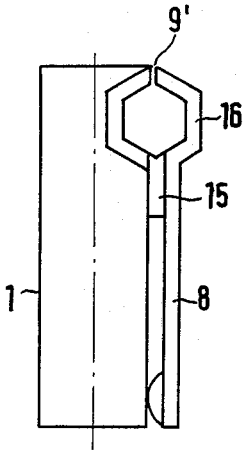
FIG. 9 is a side view of a further cap according to a sixth embodiment.

The embodiment shown in FIG. 9 corresponds, in principle, to the embodiment in FIG. 6, with the difference, however, that a protrusion 14' is not provided in the embodiment in FIG. 9 and that the receiving bore 7 is not round, but is hexagonal. The torque limitation is again maintained by the expansion of the flexible arm 16.

A further variation is illustrated in FIGS. **10*a*–10*d*, in which FIG. 10*a* shows a side view of the cap, FIG. 10*b* shows a view in direction of arrow b, FIG. 10*c* shows a section through the writing tip and FIG. 10*d*** a side view of the cap when it has been mounted on the writing insert.

In this embodiment, the receiving bore 27 is formed, on the one hand, by the free end of clip 8, and on the other hand, by the wall of cap 1 in the area of the free end of clip 8. Receiving bore 27, thus extends parallel to the axis 10 of cap 1. A protrusion 21 extends parallel to clip 8 on the wall of cap 1. The writing insert 4 is provided with four axially extending grooves.

To unscrew and/or screw the writing insert on, it is inserted onto the receiving bore 27 between clip 8 and the wall of cap 1. Protrusion 21 thereby engages in one of the grooves 22. Thus, a tongue-and-groove joint results. The meshing is brought about by the elasticity of clip 8. If too great a torque is exerted, then clip 8 deviates and protrusion 21 disengages from groove 22.

I claim:

1. A writing or drawing instrument having a writing insert which can be screwed in and out of the instrument shaft and a cap which can be placed over the writing insert and which has a clip and a receiving bore which can be placed onto the writing insert, the writing insert being removable from or inserted into the instrument shaft by means of the cap having the mounting insert disposed within the receiving bore, the receiving bore being many sided and being formed in part by the clip and in part by the outer wall of the cap, a part of the clip forming one part of the receiving bore being shiftable with respect to the part of the outer wall of the cap forming the other part of the receiving bore to limit the torque which acts on the writing insert by expanding the receiving bore.

2. A writing or drawing instrument according to claim 1, in which the receiving bore extends at right angles to the axis of the cap and the part of the clip forming one part of the receiving bore extends parallel to the axis of the cap.

3. A writing or drawing instrument according to claim 1, in that the part of the clip forming one part of the receiving bore is flexible, a free end of the clip adjoining the flexible part of the receiving bore.

4. A writing or drawing instrument according to claim 1 in which the receiving bore has a protrusion pointing inwardly, the writing insert being provided with a recess for engagement with the protrusion when the cap has been placed on the writing insert.

5. A writing or drawing instrument according to claim 1, in which the recess is a circular groove.

6. A writing or drawing instrument according to claim 4, in which the protrusion is tooth-shaped and the recess is segmental.

7. A writing or drawing instrument according to claim 6, in which the angles of mesh between the tooth-shaped protrusion and the segmental recess vary in two directions of rotation of the insert and the receiving bore.

8. A writing or drawing instrument according to claim 1, in which a part of the clip forming one part of the receiving bore is connected to the cap via a hinge, a detachable detent connection being provided between this part of the clip and its free end between the clip and the outer wall of the cap.

9. A writing or drawing instrument according to claim 1, in which a preset breaking point is provided between a part of the clip forming one part of the receiving bore and its free end between the clip and the outer wall of the cap.

10. A writing or drawing instrument according to claim 1 in which a flange is provided between the part of the clip forming part of the receiving bore and its free end between the clip and the outer wall of the cap, a slot being provided between the outer wall of the cap and this part of the clip on the opposite wall of the receiving bore.

11. A writing or drawing instrument according to claim 10, in which the flange is flexible.

12. A writing or drawing instrument according to claim 1, in which the receiving bore extends parallel to the axis of the cap and in which the parts of the clip and outer cap wall forming the receiving bore are provided in the region of the free end of the clip.

13. A writing or drawing instrument according to claim 12, in which engagement between the writing insert and the receiving bore takes place via an axially extending groove and tongue joint.

* * * * *